US006450389B1

(12) United States Patent
Clouse

(10) Patent No.: US 6,450,389 B1
(45) Date of Patent: Sep. 17, 2002

(54) STAPLER DEVICE

(76) Inventor: Carl D. Clouse, 10092 Tracy La., Delhi, CA (US) 95315

( * ) Notice: Subject to any disclaimer, the term of this patent is extended or adjusted under 35 U.S.C. 154(b) by 98 days.

(21) Appl. No.: 09/675,170

(22) Filed: Sep. 29, 2000

(51) Int. Cl.[7] ..... B25C 5/16

(52) U.S. Cl. ..... 227/134; 227/130; 227/131; 227/140; 227/155

(58) Field of Search ..... 227/108, 119, 227/134, 130, 131, 140, 148, 152, 155

(56) References Cited

U.S. PATENT DOCUMENTS

| | | | | | |
|---|---|---|---|---|---|
| 2,181,904 | A | * | 12/1939 | Maynard et al. | 227/155 |
| 2,374,770 | A | * | 5/1945 | Nasmith et al. | 227/155 |
| 2,944,262 | A | * | 7/1960 | Richman et al. | 72/325 |
| 3,119,115 | A | | 1/1964 | Bello | |
| 3,319,863 | A | | 5/1967 | Dritz | |
| 3,924,790 | A | | 12/1975 | Moeller | |
| 4,288,016 | A | | 9/1981 | Failla et al. | |
| 4,670,957 | A | * | 6/1987 | Wolford | 29/243.5 |
| D296,183 | S | | 6/1988 | Chi | |
| 4,989,438 | A | * | 2/1991 | Simon | 227/119 |
| 5,054,678 | A | | 10/1991 | Nasiatka | |
| 5,524,807 | A | | 6/1996 | Bullard | |
| 5,673,838 | A | * | 10/1997 | Reitze | 227/119 |

* cited by examiner

*Primary Examiner*—Scott A. Smith
*Assistant Examiner*—Chukwurah Nathaniel

(57) ABSTRACT

A stapler device for stapling corners of objects such as boxes and frame together. The stapler device includes an elongate support member having a generally flat bottom side, a top side, a front end and a back end; and also includes a lever assembly having a front end and a back end and being hingedly attached to the elongate support member; and further includes a staple impact assembly being removably and securely mounted at the front end of the elongate support member.

20 Claims, 2 Drawing Sheets

STAPLER DEVICE

BACKGROUND OF THE INVENTION

1. Field of the Invention

The present invention relates to a corner stapling device and more particularly pertains to a new stapler device for stapling corners of objects such as boxes and frame together.

2. Description of the Prior Art

The use of a corner stapling device is known in the prior art. More specifically, a corner stapling device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,119,115; U.S. Pat. No. 4,288,016; U.S. Pat. No. 3,924,790; U.S. Pat. No. 5,524,807; U.S. Pat. No. 3,319,863; U.S. Pat. No. 5,054,678; and U.S. Pat. No. Des. 296,183.

While these devices fulfill their respective, particular objectives and requirements, the aforementioned patents do not disclose a new stapler device. The inventive device includes an elongate support member having a generally flat bottom side, a top side, a front end and a back end; and also includes a lever assembly having a front end and a back end and being hingedly attached to the elongate support member; and further includes a staple impact assembly being removably and securely mounted at the front end of the elongate support member.

In these respects, the stapler device according to the present invention substantially departs from the conventional concepts and designs of the prior art, and in so doing provides an apparatus primarily developed for the purpose of for stapling corners of objects such as boxes and frame together.

SUMMARY OF THE INVENTION

In view of the foregoing disadvantages inherent in the known types of corner stapling device now present in the prior art, the present invention provides a new stapler device construction wherein the same can be utilized for stapling corners of objects such as boxes and frame together.

The general purpose of the present invention, which will be described subsequently in greater detail, is to provide a new stapler device which has many of the advantages of the corner stapling device mentioned heretofore and many novel features that result in a new stapler device which is not anticipated, rendered obvious, suggested, or even implied by any of the prior art corner stapling device, either alone or in any combination thereof.

To attain this, the present invention generally comprises

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stapler device which has many of the advantages of the corner stapling device mentioned heretofore and many novel features that result in a new stapler device which is not anticipated, rendered obvious, suggested, or even implied by any of the prior art corner stapling device, either alone or in any combination thereof.

It is another object of the present invention to provide a new stapler device which may be easily and efficiently manufactured and marketed.

It is a further object of the present invention to provide a new stapler device which is of a durable and reliable construction.

An even further object of the present invention is to provide a new stapler device which is susceptible of a low cost of manufacture with regard to both materials and labor, and which accordingly is then susceptible of low prices of sale to the consuming public, thereby making such stapler device economically available to the buying public.

Still yet another object of the present invention is to provide a new stapler device which provides in the apparatuses and methods of the prior art some of the advantages thereof, while simultaneously overcoming some of the disadvantages normally associated therewith.

Still another object of the present invention is to provide a new stapler device for stapling corners of objects such as boxes and frame together.

Yet another object of the present invention is to provide a new stapler device which includes an elongate support member having a generally flat bottom side, a top side, a front end and a back end; and also includes a lever assembly having a front end and a back end and being hingedly attached to the elongate support member; and further includes a staple impact assembly being removably and securely mounted at the front end of the elongate support member.

Still yet another object of the present invention is to provide a new stapler device that is easy and convenient to use.

Even still another object of the present invention is to provide a new stapler device that allows the user to stable together objects which are disposed generally at right angles to one another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
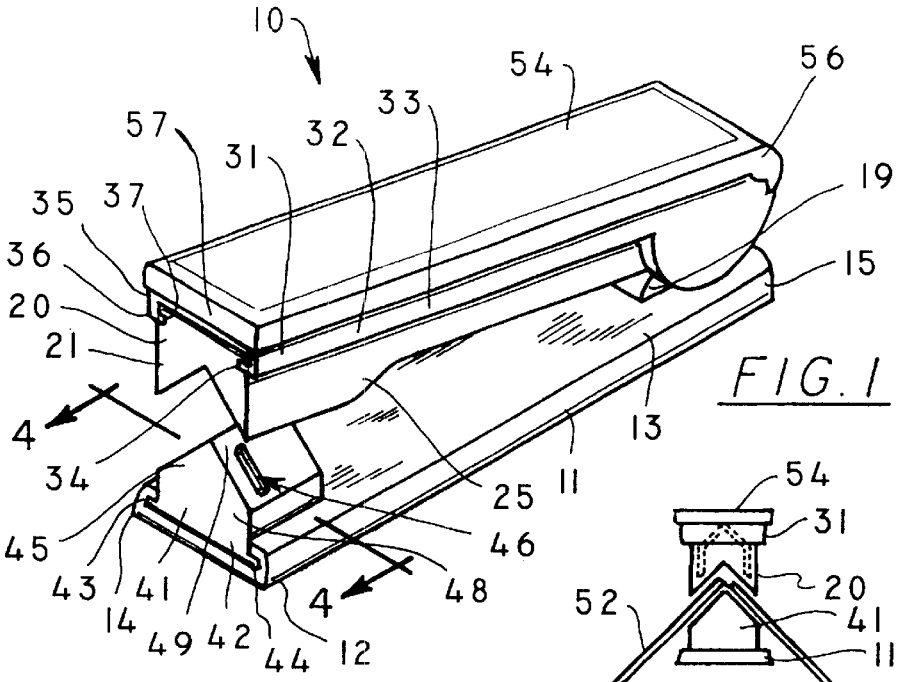
FIG. 1 is a perspective view of a new stapler device according to the present invention.
Figure 2:
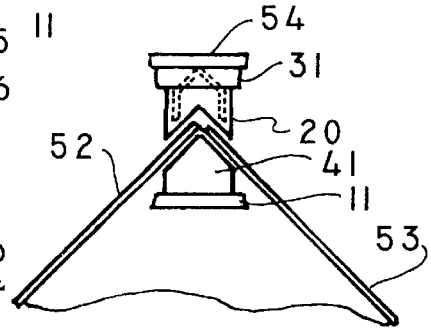
FIG. 2 is a front elevational view of the present invention shown in use.
Figure 4:
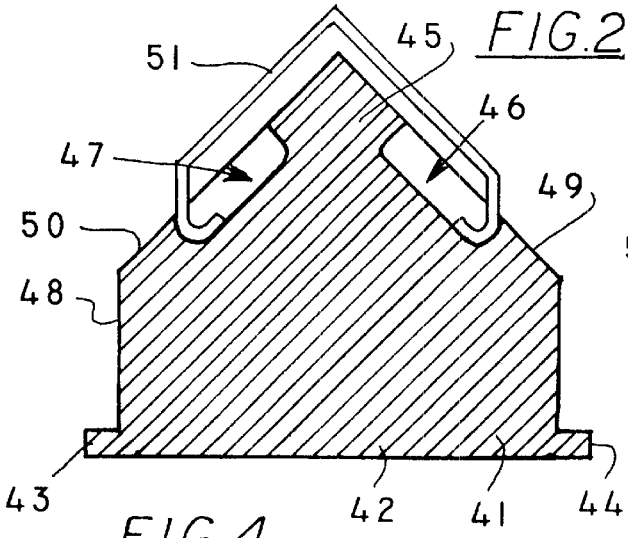
FIG. 4 is a cross-sectional view of the present invention.
Figure 3:
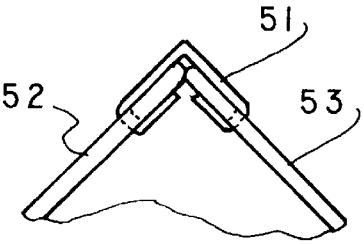
FIG. 3 is a top plan view of a stapled corner of an object.
Figure 5:
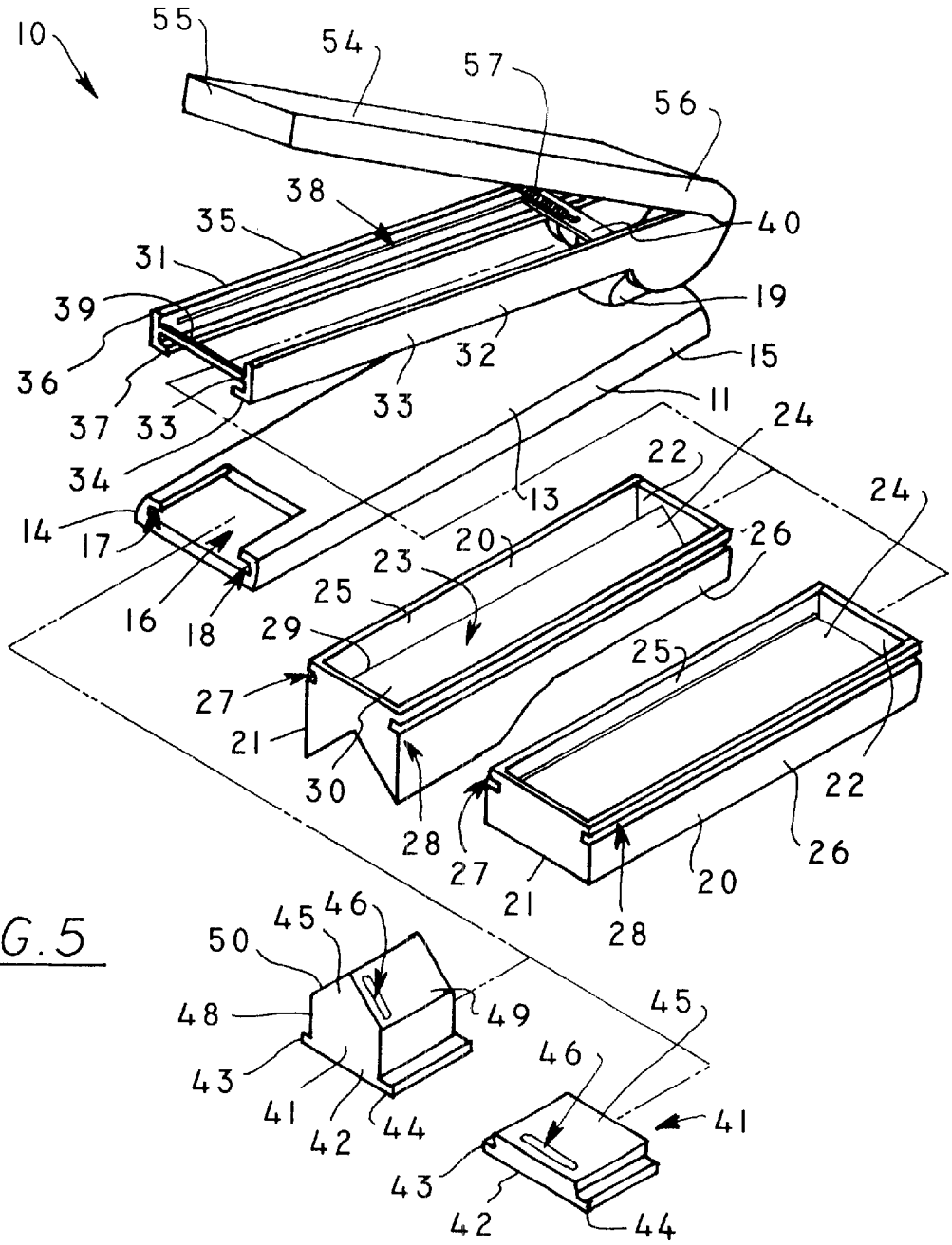
FIG. 5 is an exploded perspective view of the present invention.

With reference now to the drawings, and in particular to FIGS. 1 through 5 thereof, a new stapler device embodying the principles and concepts of the present invention and generally designated by the reference numeral 10 will be described.

As best illustrated in FIGS. 1 through 5, the stapler device 10 generally comprises an elongate support base 11 having a generally flat bottom side 12, a top side 13, a front end 14 and a back end 15. The elongate support base 11 also includes a recessed portion 16 being disposed in the top side 13 thereof and at the front end 14 thereof with the recessed portion 16 having side walls with longitudinal slots 17, 18 disposed in the side walls thus forming a track.

A lever assembly has a front end and a back end which is hingedly and conventionally attached to a bracket 19 conventionally mounted upon the elongate support base 11. The lever assembly includes an elongate cartridge member 20 having an open top 23, side walls 25, 26, front wall 21, back wall 22, and a bottom 24 which is adapted to support staples 51 thereupon. The front wall 21 is spaced from the bottom 24 of the elongate cartridge member 20 to form a staple dispensing opening which is adapted to dispense staples 51 from the elongate cartridge member 20. The elongate cartridge member 20 also includes grooves 27, 28 being disposed in an exterior of the side walls 25, 26 near the top thereof and extending a length of the elongate cartridge member 20. The lever assembly further includes an elongate cartridge support member 31 having a front end, a back end, elongate side members 32, 35 being spaced apart, a front cross member 39 conventionally interconnecting the elongate side members 32, 35, grooves 38 disposed in an interior side of the elongate side members 32, 35 and extending a length thereof, a back cross member 40 also conventionally interconnecting the elongate side members 32, 35 and being movably disposed in the grooves 38 of the elongate side members 32, 35. Each of the side members 32, 35 has a main portion 33, 36 and a flange portion 34, 37 extending inwardly of the elongate cartridge support member 31 and extending a length of the side members 32, 35 with the grooves 27, 28 of the elongate cartridge member 20 removably receiving the flange portions 34, 37 for removably mounting the elongate cartridge member 20 to the elongate cartridge support member 31. The lever assembly also includes a cover 54 having a front end 55 and a back end 56 which is hingedly and conventionally attached to the back end of the elongate cartridge support member 31. The cover 54 is also connected to the back cross member 40 with a spring member 57. A staple impact assembly is removably and securely mounted at the front end 14 of the elongate support base 11.

As a first embodiment, the bottom 24 of the elongate cartridge member 20 is spire-shaped and upwardly tapered thus forming a peak extending a length of the bottom 24. The bottom 24 of the elongate cartridge member 20 also includes first and second walls 29, 30 which are conventionally attached to one another and which are slanted downwardly away from one another. The staple impact assembly includes a body 41 having a base portion 42, an intermediate portion 48 disposed upon the base portion 42, and a spire-shaped upper portion 45 having first and second walls 49, 50 being conventionally attached to one another to form a peak and being slanted downwardly away from one another. The staple impact assembly also includes staple-receiving slots 46, 47 being laterally disposed in the first and second walls 49, 50 of the spire-shaped upper portion 45 and being generally in alignment with the staple-dispensing opening. The staple impact assembly further includes elongate flanges 43, 44 extending outwardly from either side of the base portion 42 and being adapted to be removably received in the track 17, 18 of the elongate support base 11.

As a second embodiment, the bottom 24 of the elongate cartridge member 20 includes a wall which is generally flat and which is adapted to support standard staples 51. The staple impact member includes a base portion 42 and a generally flat upper portion 45 which is disposed upon the base portion 42 and which has a staple-receiving slot 46 disposed therein and being generally in alignment with the staple-dispensing opening. The base portion 42 includes elongate flanges 43, 44 extending outwardly from either side of the base portion 42 and being adapted to be removably received in the track 17, 18 of the elongate support base 11.

In use, the user places staples 51 in the elongate cartridge member 20 and closes the cover 54 and places the objects 52, 53 to be stapled between the lever assembly and the elongate support base 11 and then presses down upon the lever assembly which causes a staple 51 to be dispensed through the staple-dispensing opening in the elongate cartridge member 20 and to come into contact with the staple impact assembly; whereupon, the staple 51 is inserted through the objects 52, 53 for stapling them together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stapler device for stapling corners of objects comprising:

an elongate support base having a generally flat bottom side, a top side, a front end and a back end;

a lever assembly having a front end and a back end and being hingedly attached to a bracket being securely disposed upon said elongate support base;

a staple impact assembly being removably and securely mounted at said front end of said elongate support base; and wherein said elongate support base also includes a recessed portion being disposed in said top side thereof and at said front end thereof, said recessed portion having side walls with longitudinal slots disposed in said side walls thus forming a track.

2. A stapler device for stapling corners of objects as described in claim 1, wherein said lever assembly includes an elongate cartridge member having an open top, side walls, front wall, back wall, and a bottom which is adapted to support staples thereupon.

3. A stapler device for stapling corners of objects as described in claim 2, wherein said front wall of said elongate cartridge member is spaced from said bottom of said elongate cartridge member to form a staple dispensing opening which is adapted to dispense the staples from said elongate cartridge member.

4. A stapler device for stapling corners of objects as described in claim 3, wherein said staple impact assembly includes a body having a base portion, an intermediate portion disposed upon said base portion, and a spire-shaped upper portion having first and second walls being attached to one another to form a peak and being slanted downwardly away from one another.

5. A stapler device for stapling corners of objects as described in claim 4, wherein said staple impact assembly also includes staple-receiving slots being laterally disposed in said first and second walls of said spire-shaped upper portion and being generally in alignment with said staple-dispensing opening of said elongate cartridge member.

6. A stapler device for stapling corners of objects as described in claim 4, wherein said staple impact assembly further includes elongate flanges extending outwardly from either side of said base portion and being adapted to be removably received in a track of said elongate support base.

7. A stapler device for stapling corners of objects as described in claim 3, wherein said staple impact assembly includes a base portion and a generally flat upper portion which is disposed upon said base portion and which has a staple-receiving slot disposed therein and being generally in alignment with said staple-dispensing opening of said elongate cartridge member, said base portion including elongate flanges extending outwardly from either side of said base portion and being adapted to be removably received in a track of said elongate support base for the purpose of permitting the stapling of the objects in a conventionally flat manner.

8. A stapler device for stapling corners of objects as described in claim 2, wherein said bottom of said elongate cartridge member is spire-shaped and upwardly tapered thus forming a peak extending a length of said bottom.

9. A stapler device for stapling corners of objects as described in claim 2, wherein said bottom of said elongate cartridge member also includes first and second walls which are attached to one another and which are slanted downwardly away from one another.

10. A stapler device for stapling corners of objects as described in claim 2, wherein said bottom of said elongate cartridge member includes a wall which is generally flat and which is adapted to support the staples.

11. A stapler device for stapling corners of objects as described in claim 1, wherein said elongate cartridge member also includes grooves being disposed in said side walls near said top thereof and extending a length of said elongate cartridge member.

12. A stapler device for stapling corners of objects as described in claim 10, wherein said lever assembly further includes an elongate cartridge support member having a front end, a back end, elongate side members being spaced apart, a front cross member interconnecting said elongate side members, grooves disposed in an interior side of said elongate side members and extending a length thereof, a back cross member also interconnecting said elongate side members and being movably disposed in said grooves of said elongate side members, each of said elongate side members having a main portion and a flange portion extending inwardly of said elongate cartridge support member and extending a length of said elongate side members, said grooves of said elongate cartridge member removably receiving said flange portions of said elongate cartridge support member for removably mounting said elongate cartridge member to said elongate cartridge support member.

13. A stapler device for stapling corners of objects as described in claim 12, wherein said lever assembly also includes a cover having a front end and a back end which is hingedly attached to said back end of said elongate cartridge support member and which is also attached to said back cross member with a spring member for biasing said cover member downward onto said elongate cartridge support member.

14. A stapler device for stapling corners of objects comprising:

an elongate support base having a generally flat bottom side, a top side, a front end and a back end, said elongate support base also including a recessed portion being disposed in said top side thereof and at said front end thereof, said recessed portion having side walls with longitudinal slots disposed in said side walls thus forming a track;

a lever assembly having a front end and a back end and being hingedly attached to a bracket being securely disposed upon said elongate support base, said lever assembly including an elongate cartridge member having an open top, side walls, front wall, back wall, and a bottom which is adapted to support staples thereupon, said front wall being spaced from said bottom of said elongate cartridge member to form a staple dispensing opening which is adapted to dispense staples from said elongate cartridge member, said elongate cartridge member also including grooves being disposed in said side walls near said top thereof and extending a length of said elongate cartridge member, said lever assembly further including an elongate cartridge support member having a front end, a back end, elongate side members being spaced apart, a front cross member interconnecting said elongate side members, grooves disposed in an interior side of the elongate side members and extending a length thereof, a back cross member also interconnecting said elongate side members and being movably received in said grooves of said elongate side members, each of said side members having a main portion and a flange portion extending inwardly of said elongate cartridge support member and extending a length of said side members, said grooves of said elongate cartridge member removably receiving said flange portions for removably mounting said elongate cartridge member to said elongate cartridge support member, said lever assembly also including a cover having a front end and a back end which is hingedly attached to said back end of said elongate cartridge support member and which is also attached to said back cross member with a spring member; and a staple impact assembly being removably and securely mounted at said front end of said elongate support base.

15. A stapler device for stapling corners of objects as described in claim 14, wherein said bottom of said elongate cartridge member being spire-shaped and upwardly tapered thus forming a peak extending a length of said bottom, said bottom of said elongate cartridge member also includes first and second walls which are attached to one another and which are slanted downwardly away from one another, said staple impact assembly including a body having a base portion, an intermediate portion disposed upon said base portion, and a spire-shaped upper portion having first and second walls being attached to one another to form a peak and being slanted downwardly away from one another, said staple impact assembly also including staple-receiving slots being laterally disposed in said first and second walls of said spire-shaped upper portion and being generally in alignment with said staple-dispensing opening, said staple impact assembly further including elongate flanges extending outwardly from either side of said base portion and being adapted to be removably received in said track of said elongate support base.

16. A stapler device for stapling corners of objects as described in claim 14, wherein said bottom of said elongate cartridge member includes a wall which is generally flat and which is adapted to support standard staples, said staple impact member including a base portion and a generally flat upper portion which is disposed upon said base portion and which has a staple-receiving slot disposed therein and being generally in alignment with said staple-dispensing opening, said base portion including elongate flanges extending outwardly from either side of said base portion and being adapted to be removably received in said track of said elongate support base.

17. A stapler device for stapling objects comprising:

an elongate support base having a bottom side, a top side, a front end and a back end;

a lever assembly having a front end and a back end and being pivotally attached to said elongate support base;

a pair of interchangeable staple impact assemblies being removably and interchangeably mounted at said front end of said elongate support base; and a pair of interchangeable elongate cartridge members being removably and interchangeably mounted on said lever assembly, said cartridge members each having an open top and a bottom for supporting staples thereupon;

wherein said bottom of a first one of said pair of interchangeable elongate cartridge members is spire-shaped and upwardly tapered thus forming a peak extending a length of said bottom, said bottom of said elongate cartridge member also includes first and second walls which are attached to one another and which are slanted downwardly away from one another, and wherein a corresponding first one of said pair of interchangeable staple impact assemblies includes a body having a base portion, an intermediate portion disposed upon said base portion, and a spire-shaped upper portion having first and second walls being attached to one another to form a peak and being slanted downwardly away from one another; and wherein said bottom of a second one of said pair of interchangeable elongate cartridge members includes a wall which is generally flat for supporting standard staples, and wherein a second one of said pair of interchangeable staple impact assemblies includes a base portion and a generally flat upper portion which is disposed upon said base portion and which has a staple-receiving slot disposed therein.

18. A stapler device for stapling corners of objects as described in claim 17, wherein said elongate support base also includes a recessed portion being disposed in said top side thereof and at said front end thereof, said recessed portion having side walls with longitudinal slots disposed in said side walls thus forming a track;

wherein said base portion of said first staple impact assembly includes staple-receiving slots being laterally disposed in said first and second walls of said spire-shaped upper portion and being generally in alignment with said staple-dispensing opening, said staple impact assembly further including elongate flanges extending outwardly from either side of said base portion for being removably received in said track of said elongate support base; and wherein said base portion of said second staple impact assembly includes elongate flanges extending outwardly from either side of said base portion for being removably received in said track of said elongate support base.

19. A stapler device for stapling corners of objects as described in claim 17, wherein said elongate cartridge member also includes side walls with grooves being disposed therein and extending a length of said elongate cartridge member.

20. A stapler device for stapling corners of objects as described in claim 19, wherein said lever assembly further includes an elongate cartridge support member having a front end, a back end, elongate side members being spaced apart, a front cross member interconnecting said elongate side members, grooves disposed in an interior side of said elongate side members and extending a length thereof, a back cross member also interconnecting said elongate side members and being movably disposed in said grooves of said elongate side members, each of said elongate side members having a main portion and a flange portion extending inwardly of said elongate cartridge support member and extending a length of said elongate side members, said grooves of said elongate cartridge member removably receiving said flange portions of said elongate cartridge support member for removably mounting said elongate cartridge member to said elongate cartridge support member.

* * * * *